United States Patent [19]

Weller et al.

[11] 3,962,856

[45] June 15, 1976

[54] DOFFING APPARATUS

[75] Inventors: Heinrich Weller, Monchen-gladbach; Heinz Kaschewske, Korschenbroich, both of Germany

[73] Assignee: Maschinenfabrik Heinz Weller, Monchen-gladbach, Germany

[22] Filed: Oct. 16, 1974

[21] Appl. No.: 515,153

[52] U.S. Cl. ..... 57/52

[51] Int. Cl.[2] ..... D01H 9/04

[58] Field of Search ..... 57/52, 53, 54; 242/41

[56] References Cited

UNITED STATES PATENTS

| | | | |
|---|---|---|---|
| 1,113,434 | 10/1914 | Hartley | 57/54 |
| 1,224,800 | 5/1917 | Spence | 57/54 |
| 1,601,340 | 9/1926 | Boyd et al. | 57/52 |
| 2,043,607 | 6/1936 | Dawes | 57/54 |
| 2,523,859 | 9/1950 | Bradish | 57/54 |
| 2,582,696 | 1/1952 | Haythornthwaite | 57/52 |
| 2,995,002 | 8/1961 | Leach et al. | 57/52 |
| 3,466,863 | 9/1969 | Wachendorf | 57/52 |
| 3,491,526 | 1/1970 | Krauss et al. | 57/54 X |
| 3,530,657 | 9/1970 | Grau | 57/54 X |
| 3,678,672 | 7/1972 | Brissey et al. | 57/52 |

FOREIGN PATENTS OR APPLICATIONS

| | | | |
|---|---|---|---|
| 592,464 | 3/1959 | Italy | 57/52 |

*Primary Examiner*—John Petrakes
*Attorney, Agent, or Firm*—Herbert E. Kidder

[57] ABSTRACT

A multiple spindle spinning frame has a plurality of tapered rotatable spindles carrying bobbins upon which fiber is wound, and each spindle has a disc below the bobbin which is movable axially with respect to the spindle. Below each bobbin is a vertically reciprocable plunger, the top end of which abuts against the underside of the disc to raise the bobbin from the spindle. The plungers are connected to a common bar, that is raised and lowered by one arm of a double-arm lever, the other arm of which is connected to a reciprocable bar, one end of which is connected to a pivoted lever arm. Also connected to the lever arm is a flexible tension member which is wound onto a winding reel driven by a reversible electric motor. A pivoted lever arm has one end that rides on the windings that are wound onto the winding reel, while the other end engages a first limit switch to shut off the motor when the windings have built up on the winding reel as the bobbins are ejected. A second limit switch is engageable by the first-named lever arm as the latter reaches the end of its travel during reverse operation of the motor, so as to shut off the motor as the first-named lever arm reaches its initial position.

7 Claims, 1 Drawing Figure

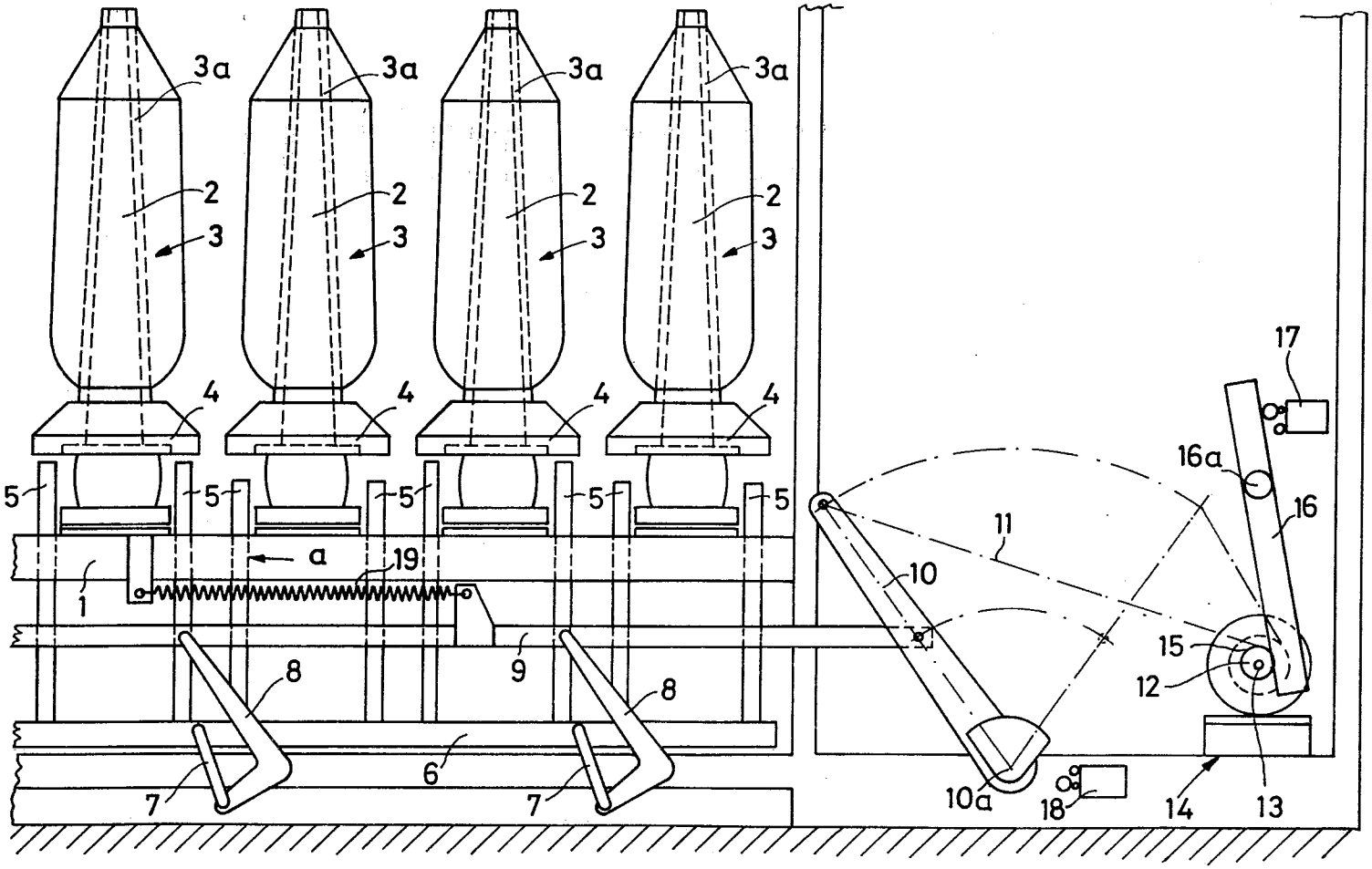
17
16
16a
13
15
12
14
18
11
10
10a
3a
2
3
4
5
8
7
9
6
19
a
1

DOFFING APPARATUS

The invention relates to a doffing apparatus for freeing cops or packages from the spindle shafts of spinning-, twisting- or winding-frames.

The development of tear-resistant synthetic fibres, and the processing of these fibres in modern high productivity machines, requires the subjection of the threads or yarns to a high degree of tension in the vicinity of the cops or packages into which the yarns or threads are being wound. The tension thus created frequently results in the packages adhering to the spindle shafts through the creation of constrictions in the bobbins, forming the cores of the packages, which are generally made of cardboard or synthetic plastics material. The packages can then only be pulled away from the spindle shafts by the exercise of considerable force.

An object of the present invention is therefore to provide an apparatus for freeing packages from the spindle shafts of spinning-, twisting- or winding-frames, thereby enabling the packages to be readily lifted away from the spindle shafts.

The present invention accordingly provides a doffing apparatus, for freeing packages wound on bobbins from the spindle shafts of spinning-, twisting- or winding - frames, comprising a plurality of annular discs for slidable arrangement on respective spindle shafts below the associated packages, and a thrusting mechanism for thrusting the annular discs against the bobbins of the packages, thereby freeing the packages from the spindle shafts.

The thrusting mechanism preferably comprises a motor coupled via a lever arrangement to a plurality of plungers adapted to bear against the annular discs.

The plungers, which can be thrust against the annular discs are, conveniently, interconnected by means of a cross beam, so that all the annular discs on a spindle rail can be actuated by a common thruster mechanism. The plungers are preferably of different lengths, so that the thruster mechanism does not have to exert a simultaneous thrusting force on all the cops or packages. If such simultaneous thrusting force had to be exerted, the thruster mechanism would have to be constructed with commensurate, additional strength.

The motor preferably includes a spindle drivable via reduction gearing, and an elongate flexible member arranged to be wound into a coil by the spindle is attached at an end of the flexible member remote from the spindle to one end of a first lever of the lever arrangement to apply a pull to said one end. The lever arrangement of the thrusting mechanism may comprise a one-arm lever, which is pivotable about a fixed point. The flexible member, which leads to the motor, and also a bar engage this one-arm lever, and the bar is in its turn linked to the plungers (which are fixedly guided in the spindle rail), in such manner that, when the said flexible member and bar are subjected to a pulling force, the plungers move into position against the annular discs.

Preferably, the said linkage between the bar and the plungers is effected by means of two-arm levers, which are each mounted to swivel about a respective fixed fulcrum, one of the arms of each lever engaging the bar and the other arm engaging, through the intermediary of a connecting member, the plungers.

The pull bar may further be equipped with a return spring which — when an action has been completed for freeing the packages, and when the motor is running in its reverse direction of rotation — retracts the bar into its starting position, the flexible member (which, preferably, is constituted as a chain) being thereby tensioned. The invention will now be more particularly described by way of example with reference to the accompanying drawing which illustrates a doffing apparatus by means of a diagrammatic side elevational view.

A spindle rail 1 of a spinning frame has a number of conical spindle shafts 2. Bobbins 3*a* are arranged on these spindle shafts 2 and are driven at a high speed of rotation by means of a drive (not shown), for the purpose of winding thread or yarn into cops 3. Annular discs 4 are provided for lifting the completed cops free of the spindle shafts 2, and are slidably arranged on the spindle shafts 2 below the cops 3. Plungers 5 are arranged under these annular discs 4 and pass through the spindle rail 1, which serves as a guide for the plungers 5. The plungers 5 can be thrust against the annular discs 4 and thus lift the cops 3 from the spindle shafts 2.

All the plungers 5 are interconnected by means of a crossbeam 6, so that they can be simultaneously raised or lowered. The plungers 5 are of different lengths, so as to ensure that all of them will not be simultaneously operated.

The crossbeam 6 is connected by way of pivoted members 7, to one arm of rotatably mounted two-arm levers 8. The other arm of each of the levers 8 is articulated to a bar 9 which, in its turn, is coupled to a lever 10. The lever 10 is pivotally mounted about a fulcrum 10*a* located in the winding frame.

A chain 11 engages the lever 10 at a point remote from the fulcrum 10*a* and is wound round a winding reel 12, which is mounted on a spindle 13 of a motor 14 provided with reduction gearing, to form a coil 15. The coil 15, presses against a longer arm of a two-arm lever 16, pivoted about a fulcrum 16*a*. When the chain 11 has fully unwound from the reel 12, the lever 16 bears with its shorter arm against a limit switch 17, which is arranged thereby to switch off the motor 14.

In order to provide for switching off the motor 14 when the chain 11 has been fully coiled around the reel 12, the lever 10 is arranged to bear against a limit switch 18, arranged thereby to switch off the motor 14.

The bar 9 is also coupled to a return spring 19 which, when the chain 11 is being uncoiled from the reel 12, pulls the bar 9 in the direction of arrow *a*.

In the drawing the apparatus is illustrated with the chain 11 in its uncoiled condition, the plungers 5 being in their inoperative position, that is to say the position in which they are not pressed against the annular discs 4. The geared motor 14 is switched on manually by the operator when the bobbins are full and it is desired to thrust the cops 3 from the spindle shafts 2; and the chain 11 then becomes coiled round the reel 12. At the same time lever 10 and the bar 9 are shifted towards the motor 14 so that the crossbeam 6, and hence the plungers 5, are lifted through the intermediary of the levers 8 and pivoted members 7. As soon as the plungers 5 bear against the annular discs 4, the latter are thrust upwards and, accordingly, lift the cops 3 from the spindle shafts 2. After the doffing action thus performed has been completed, the chain 11 has become fully coiled round the reel 12, and the swivel lever 10 has engaged with the limit switch 18 to switch off the motor 14. The motor 14 can now be manually switched on for rotation in the opposite direction, so that the chain 11 uncoils from the reel 12, the pull bar 9 being pulled by the spring 19 in the direction of arrow *a*, so that the chain 11 remains in a continuously tensioned condition.

What we claim is:

1. In a spinning frame having a plurality of tapered rotatable spindles, each carrying a bobbin upon which fiber is wound, and each spindle having a disc mounted thereon below its respective bobbin, said disc being movable axially with respect to the spindle:

a vertically reciprocable plunger located below each bobbin and engageable with the underside of said disc to lift the bobbin free of the spindle;

linkage means connected to the plungers to move them upwardly in unison;

a lever arm pivoted for angular movement;

said linkage means being connected to said lever arm at a point spaced from said pivot;

a reversible motor driving a winding reel;

a flexible tension member attached to said lever arm at a point spaced from said pivot, and wrapped around said winding reel, whereby as said motor is operated in one direction, the flexible tension member is wound onto the winding reel, causing said linkage means to raise said plungers and thereby eject said bobbins from said tapered spindles; and means for stopping said motor automatically when said bobbins have been ejected.

2. The invention as set forth in claim 1, wherein said linkage means comprises a reciprocable bar which is connected at one end to said lever arm; at least one double-arm lever pivoted for swinging movement and having one of the arms connected to said bar; the other arm of said double-arm lever being connected to said plungers so that when the double-arm lever turns through an angular distance in one direction, said plungers are raised to eject said bobbins.

3. The invention as set forth in claim 2, wherein said plungers are connected to a common bar; and said other arm of said double-arm lever is connected to said common bar.

4. The invention as set forth in claim 2, which further includes a return spring connected to said reciprocable bar; said spring being stretched when said plungers are raised; and said spring pulling said reciprocable bar back to its initial position when said motor is operated in the other direction.

5. The invention as set forth in claim 2, wherein said means for stopping the motor automatically when the bobbins have been ejected comprises a limit switch connected to the motor circuit; and a second lever arm pivotally supported adjacent said motor; said second lever arm having one free end thereof riding on the windings of said flexible tension member that are wound onto said winding reel; another portion of said second lever arm engaging said limit switch to actuate the same so as to turn off the motor when the amount of flexible tension member wound onto the winding reel corresponds to the angular travel of said first-named lever arm required to eject the bobbins.

6. The invention as set forth in claim 5, which further includes means for automatically stopping the motor when it has operated in the reverse direction to unwind said tension member from said winding reel.

7. The invention as set forth in claim 6, wherein said last-named means comprises a second limit switch that is engageable by said first named lever arm as the latter reaches the end of its travel during reverse operation of the motor, during which the tension means is unwound from said winding reel, said second limit switch being actuated by said lever arm to switch off the motor.

* * * * *